United States Patent [19]

Fane

[11] 3,986,374

[45] Oct. 19, 1976

[54] WELF KNITTED FABRIC SIMULATING WOVEN CLOTH

[75] Inventor: Keble Philip Fane, East Goscote, England

[73] Assignee: Goscote Engineering Limited, East Goscote, England

[22] Filed: Nov. 14, 1974

[21] Appl. No.: 523,925

[52] U.S. Cl. ..... 66/190; 66/197

[51] Int. Cl.[2] ..... D04B 7/14

[58] Field of Search ..... 66/190, 200, 196, 197, 66/9 R

[56] References Cited

UNITED STATES PATENTS

| | | | |
|---|---|---|---|
| 879,681 | 2/1908 | Scott | 66/94 X |
| 2,103,133 | 12/1937 | Adamson | 66/190 |
| 2,223,749 | 12/1940 | Thurston et al. | 66/190 X |
| 2,236,758 | 4/1941 | Lumsden | 66/190 |
| 2,653,463 | 9/1953 | Crimmins | 66/190 |

FOREIGN PATENTS OR APPLICATIONS

| | | | |
|---|---|---|---|
| 584,802 | 11/1924 | France | 66/105 |
| 1,440,932 | 4/1966 | France | 66/196 |
| 252,543 | 10/1970 | U.S.S.R. | 66/197 |

*Primary Examiner*—Mervin Stein
*Assistant Examiner*—A. M. Falik
*Attorney, Agent, or Firm*—Edelson and Udell

[57] ABSTRACT

A knitted rib or purl stitch fabric the ground structure of which has two faces of knitted loops drawn in respectively opposite directions. Courses of the loops of one face have inserted into them unknitted weft yarn contrasting with the ground structure. The inserted yarn is, without itself being knitted, knocked-over with knitted loops in spaced wales of said one face so as to be locked into the ground structure by virtue of being trapped between needle loops and adjacent sinker loops of both faces. Elsewhere the inserted yarn is floated across the fronts of knitted loops in intervening wales of said face and across the backs of oppositely drawn knitted loops of the other face.

5 Claims, 6 Drawing Figures

FIG. 3

Figure 1:
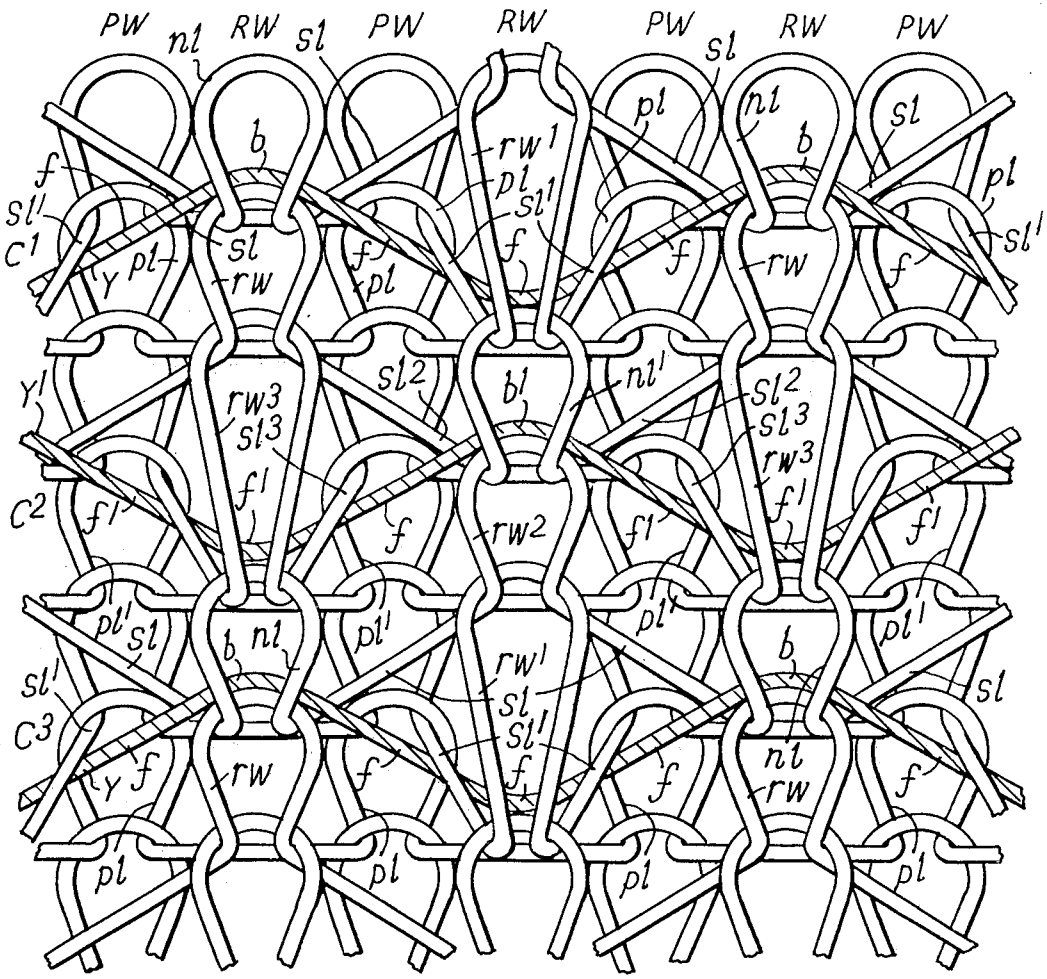

| | | | | | | | | | |
|---|---|---|---|---|---|---|---|---|---|
| | 2 | × | ○ | × | | ○ | | ○ | |
| | 1 | — | — | — | • | — | • | — | • |
| KC | 6 | | ○ | | | ○ | | ○ | |
| KC | 5 | × | | × | ○ | | ○ | | ○ |
| KC | 4 | — | • | — | — | • | — | • | — |
| KC | 3 | | | | ○ | | ○ | | ○ |
| KC | 2 | × | ○ | × | | ○ | | ○ | |
| KC | 1 | — | — | — | • | — | • | — | • |
| | | C | $D_e$ | C | $D_o$ | $D_e$ | $D_o$ | $D_e$ | $D_o$ |
| | | RK | | | | DK | | | |

WELF KNITTED FABRIC SIMULATING WOVEN CLOTH

This invention relates to weft knitted fabrics, and has reference particularly to such fabrics of the general class in which the looped structure comprises concatenations of knitted loops some of which are drawn in one direction and others in the opposite direction.

It is primarily the intention to apply the invention to rib knitted fabric, i.e., so-called double jersey fabric, comprising alternate single, or spaced pairs of groups of adjoining, plain needle wales and intervening single or intervening pairs of groups of adjoining, rib needle wales.

There is, however, no limitation in this respect since the invention could also be applied to various purl fabrics comprising alternate single, or spaced pairs or groups of adjoining, courses of plain loops and intervening single or intervening pairs or groups of adjoining, purl courses.

The invention is also applicable to weft knitted fabrics incorporating various combinations of both rib and purl stitch effects.

All of such knitted fabrics are, generally speaking, double the thickness of a plain fabric inasmuch as they have, by virtue of natural contraction widthwise or/and lengthwise, face wales and back wales drawn in the respectively opposite directions aforesaid.

As well known to those acquainted with the machine knitting art, knitted fabrics of the class concerned are, broadly speaking, produced on any appropriate two-bed knitting machines wherein needles operating in the opposed needle beds draw loops in respectively opposite directions. Thus, in a rib machine such, for instance, as a circular knitting machine of the cylinder and dial type, the cylinder needles and the co-operating dial needles are suitably set out to produce various rib combinations, e.g., $1 \times 1$ (alternate single plain wales and intervening single rib wales) $2 \times 2$, 2, $3 \times 1$ and so on. Similar remarks apply to V-bed flat knitting machines set up for rib knitting.

However, a links and links or purl stitch machine, either of the circular type having two superimposed needle cylinders or a flat bed machine having two opposed flat beds in the same horizontal plane, is capable of producing either purl fabric or rib fabric or combinations of both and is for this purpose equipped with a single set of double-ended latch needles, a corresponding set of associated needle-actuating sliders in each bed and pattern slider-operating means for effecting systematic transference of some or all of the needles from either bed to the other, according to knitting requirements.

The knitted fabrics of this invention can accordingly be made on any of such machines.

The object of the present invention is to provide improved weft knitted fabrics of the class herein referred to which, besides being pleasingly decorative, have increased stability notwithstanding low weight.

A particular aim is the production of knitted fabrics of this class which can be boldly decorated by relatively expensive patterning yarns introduced only sparingly.

Yet another aim is the production of a knitted fabric of the class herein referred to which is in the nature of a very stable cloth in so far as separate patterning yarns, additional to the ground yarn, are respectively introduced into both, i.e., the front and back faces of the fabric.

According to this invention, desired courses of the loops drawn in the direction to form one of the faces of weft knitted fabric simulating a woven fabric have inserted and locked into them coursewise undulating unknitted, i.e., laid-in, weft yarn separate from and contrasting with knitted yarn composing the ground structure of the fabric, said inserted or laid-in yarn in each of the desired courses, without itself being knitted, being knocked-over together with knitted loops either in alternate single wales, or in spaced pairs or groups of adjoining wales, of said face suchwise as to be locked into the ground structure by virtue of being sandwiched and trapped between needle loops and adjacent sinker loops of both faces, and being elsewhere floated across the fronts of the knitted loops in the intervening single wales, or the intervening pairs or groups of adjoining wales, of the first mentioned face and across the backs of opposite drawn knitted loops of the other face.

Thus, as will be appreciated, caught in portions of the inserted or laid-in weft yarn knocked over with the relevant knitted loops of the face concerned extend across the fronts of these loops and are thus exposed to view on that face, whereas the floated portions of said yarn extending across the fronts of the remaining loops of the face and the backs of knitted loops of the other face are practically hidden from view for the reason just stated, viz. that they are sandwiched and trapped between knitted and sinker loops of both faces of the fabric. The inserted yarn is in part positively locked into the fabric by virtue of extending through and being interengaged with those sinker loops immediately adjacent to the knitted loops together with which the appropriate portions of the inserted yarn are knocked over.

In accordance with another feature of the invention, the coursewise spaced points at which the relevant bights of inserted weft yarn are caught into the fabric in each of desired courses, by virtue of being knocked over together with knitted loops in those courses, at either or at each face of the fabric, are preferably staggered from course to course to achieve a more uniform distribution over the face of the exposed knocked-over bights.

Inserted weft yarns of any appropriate and desired character may be incorporated into the improved rib or purl fabric. For instance, where enhanced stability combined with low weight is the more important factor, then ordinary yarns, including soft yarns, may be used, albeit that they may contrast in colour with the ground yarn. But where decoration is the important factor, then it is possible to insert or lay-in, say, various metallic yarns such as those known as Lurex yarns, acrylic tweed yarns or slub yarns.

An important feature of the method of making the improved weft knitted fabric consists in so operating, at a weft inserting station, the set of needles in the particular bed of a rib or purl stitch knitting machine on which are drawn the loops composing a face of the fabric wherein unknitted yarn is to be inserted or laid-in that alternate ones of these needles, or spaced groups thereof, occupy advanced, e.g., tuck, positions at saiid station whilst the intervening ones or groups of the same set of needles are in retracted positions; laying a weft yarn on to the advanced needles and pressing this yarn through the plane of the retracted needles;

and subsequently advancing the retracted needles so that the inserted yarn passes alternately to the fronts and the backs of the alternate and intervening needles or groups of needles respectively and becomes interlaced with and trapped and retained in rib or purl fabric subsequently produced on both sets of needles in the machine.

It is to be understood that the term "front" applied to a needle means that edge of the needle from which the hook protrudes forwardly, the "back" of the needle being its opposite edge in contact with the back or bottom of the trick in the needle bed.

The needles of the relevant set which are in advanced positions at the weft inserting station are so disposed that the inserted yarn extends across the hooks of such needles and is subsequently, i.e., either at the next or at a following knitting station, knocked over said needles without being knitted.

This particular method of inserting a weft yarn may advantageously be carried out by the weft inserting or lay-in wheel hereinafter to be described with reference to the accompanying drawings. Such wheel has a peripheral series of spaced nibs on which a yarn to be inserted is guided between selected needles of the relevant set at the weft inserting station. The inserted yarn is laid by the relevant nibs onto the advanced needles and is pressed through the plane of the retracted needles by the remaining nibs.

Alternatively, this method of inserting or laying-in a yarn may be effected by the use of externally mounted needle-deflecting cams arranged to deflect required needles of the relevant set in such a manner that the inserted yarn extends alternately across the fronts and the backs of the alternate and intervening needles or groups of needles of the set respectively.

One or more weft inserting or lay-in wheels or needle-deflecting cam arrangements may be provided in association with either or each of the two needle beds.

Figure 2:
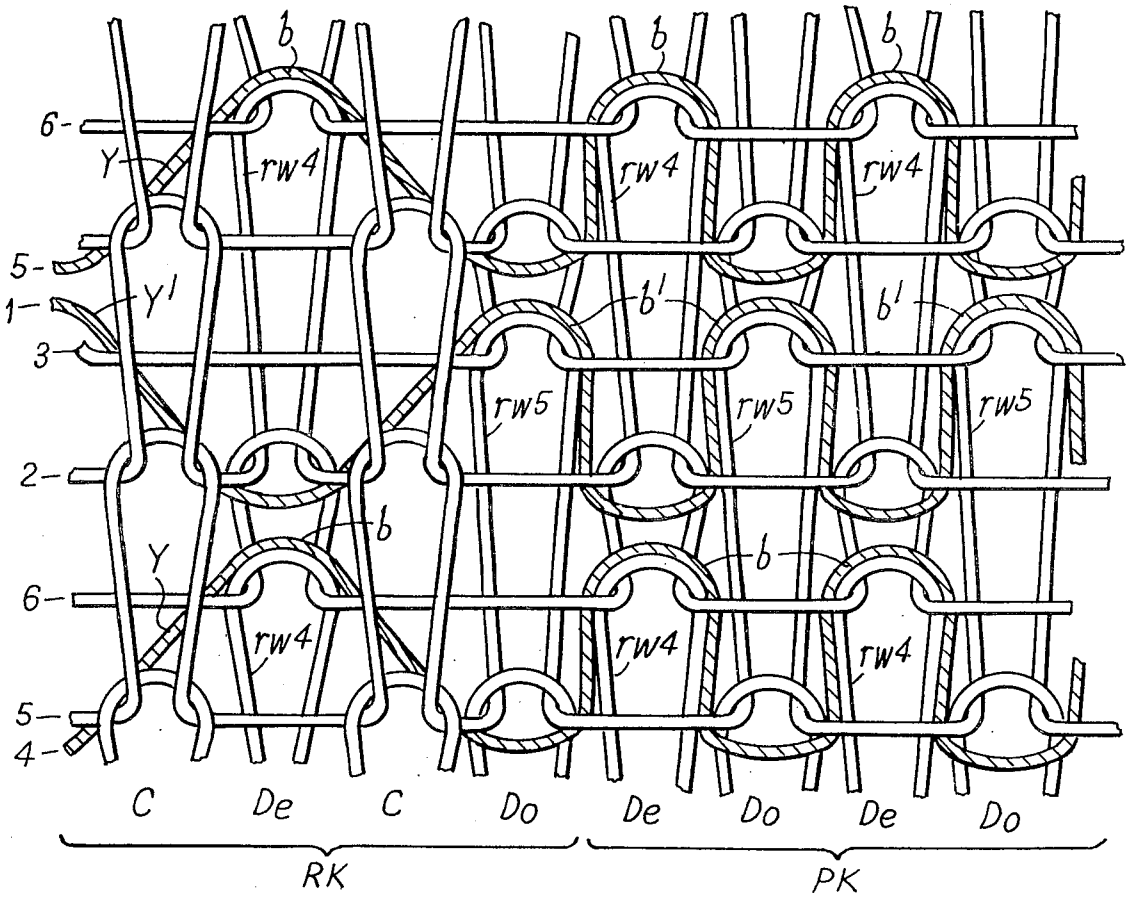
Figure 5:
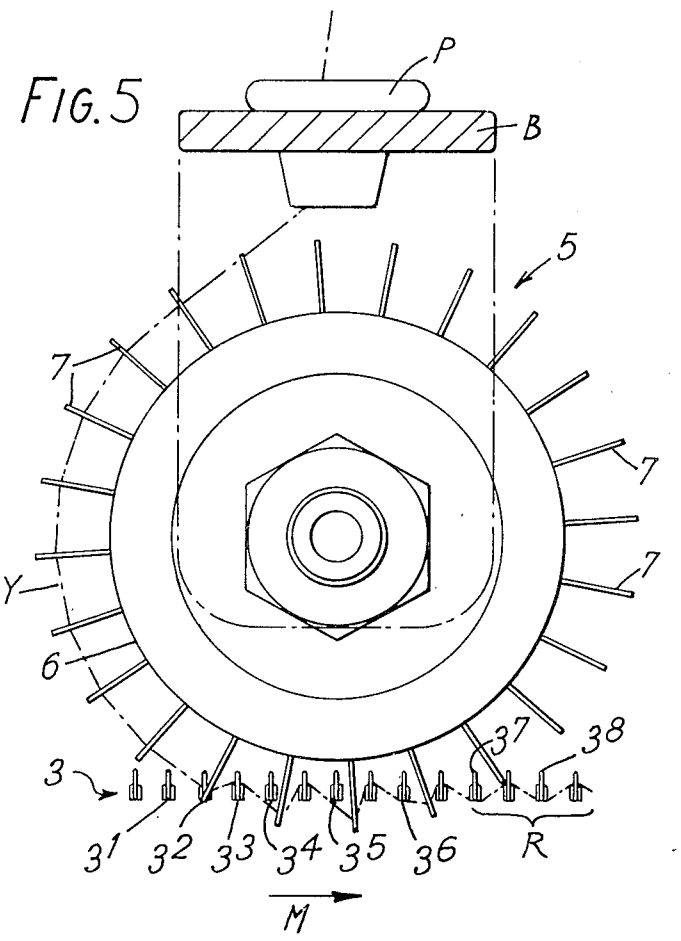
Figure 4:
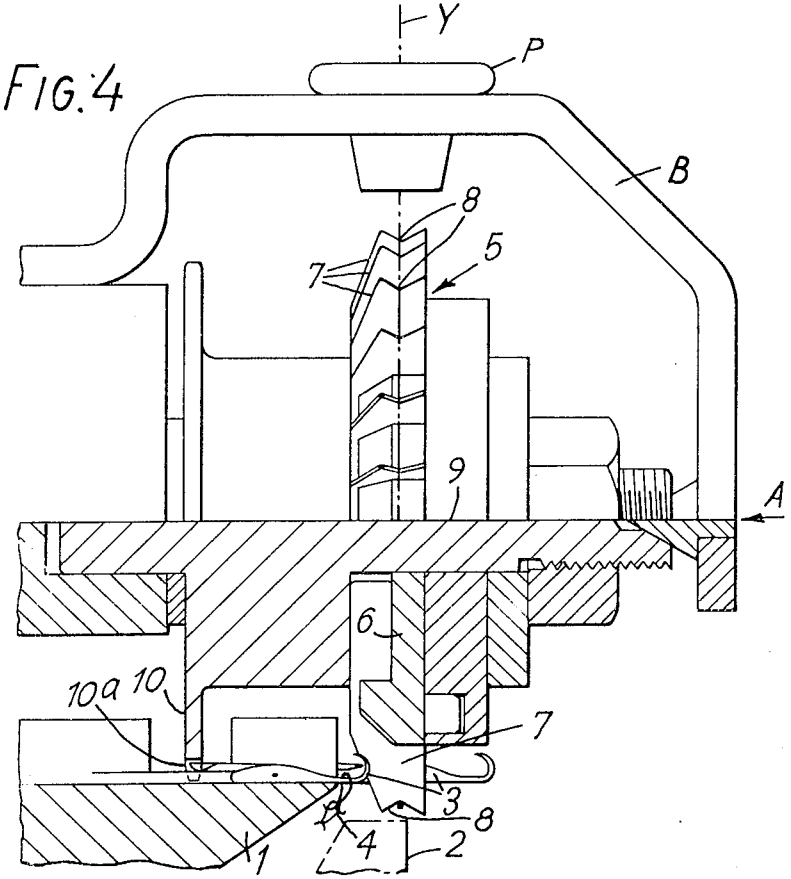
Figure 6:
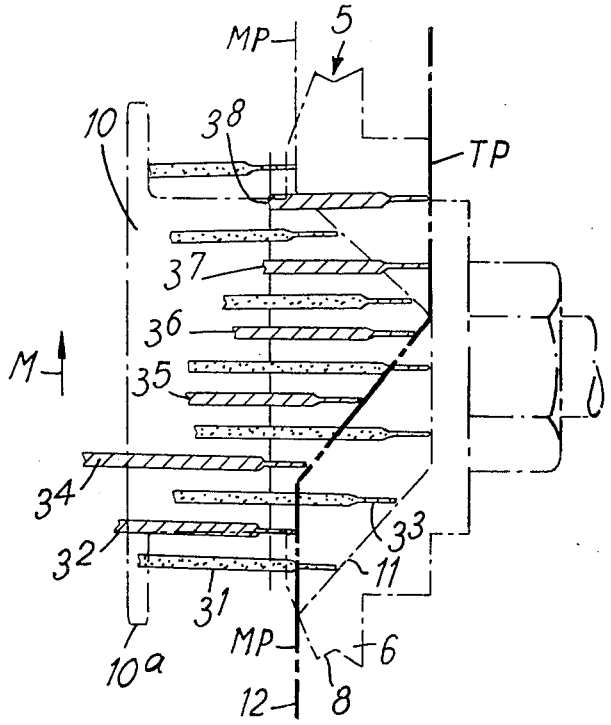

In order that the invention may be more clearly understood and readily carried into practical effect, specific examples of the improved knitted fabrics will now be described with reference to the accompanying drawings, wherein, FIG. 1 is the back or dial side of a fragmentary portion of a 1 × 1 modified Milano Rib fabric incorporating inserted, i.e., unknitted weft yarns in accordance with the invention, FIG. 2 illustrates the application of the invention to a portion of 1 × 1 pique (i.e., two-colored jacquard) rib knitting which adjoins a plain knit panel, the front or cylinder side of the fabric in this case being shown, FIG. 3 shows, in conventional graph form, the knitting cycle for the production of the fabric represented in FIG. 2, FIG. 4 is a side view, partly in section, of the hereinbefore mentioned weft inserting wheel fitted to a cylinder and dial knitting machine, FIG. 5 is a view in the direction of arrow A in FIG. 4, and FIG. 6 is a diagrammatic plan view corresponding to FIGS. 4 and 5.

The specific example illustrated in FIG. 1, applied to a 1 × 1 modified Milano Rib fabric produced on an eight-feed circular knitting machine of the cylinder and dial type and having unknitted weft yarns inserted, i.e., laid-in, to appear at one face only of the fabric will now be described. FIG. 1 shows the technical back (dial side) of the fabric structure, i.e., the face thereof remote from that on which knocked-over bights of the inserted weft yarns are exposed to view.

In FIG. 1 the wales of plain loops knitted on cylinder needles are designated PW whereas the wales of rib loops knitted on dial needles are designated RW. In each of courses $C^1$ and $C^3$, caught in bights *b* of inserted yarn Y are knocked-over together with rib loops *rw* knitted on particular alternate dial needles hereinafter for convenience designated the 'A' needles, the remaining portions *f* of the yarn Y floating both across the fronts of rib loops $rw^1$ knitted on intervening dial needles hereinafter for convenience designated the 'B' needles and also across the backs of the plain knitted loops *pl*. In the illustrated intermediate course $C^2$, on the other hand, caught in bights such as $b^1$ of inserted weft yarn $Y^1$ are knocked-over together with rib loops such as $rw^2$ knitted on 'B' dial needles, the remaining portions $f^1$ of the yarn $Y^1$ floating both across the fronts of rib loops $rw^3$ knitted on 'A' dial needles and also across the backs of plain knitted loops $pl^1$.

Each inserted weft yarn Y and $Y^1$ is, by virtue of the described construction, sandwiched or trapped between needle loops and adjacent sinker loops of both faces of the fabric. Thus, for instance, each of the yarns Y in FIG. 1 is trapped between needle loops *nl* and *pl* and the sinker loops *sl* and $sl^1$ whereas the yarn $Y^1$ is similarly trapped between the needle loops $nl^1$ and $pl^1$ and the sinker loops $sl^2$ and $sl^3$. This interengagement of inserted yarns and needle and sinker loops makes it virtually impossible to pull said inserted or laid-in yarns out of the rib knitted structure.

It will also be realized from FIG. 1 that each of the inserted weft yarns Y and $Y^1$ has its caught-in but unknitted bights knocked-over together with knitted loops in the course next to that in which the said yarn was initially introduced. That is to say, each weft yarn after being first introduced into the fabric and formed into unknitted bights, is held prior to such bights being knocked-over in the subsequently produced course. By virtue of this feature, each inserted weft thread locked into the ground structure undulates in the weftwise direction.

The aforementioned 'A' and 'B' dial needles are not, of course, shown.

The eight-feed circular knitting machine on which this fabric is knitted consists of a first weft inserting feed at which one weft yarn is laid-in over 'A' needles, a second weft inserting feed at which another weft yarn is laid-in over 'B' needles and six knitting feeds functioning in two successive identical cycles each of three feeds as follows:

| | |
|---|---|
| Knitting Feed 1: | All cylinder needles knitting; alternate dial needles (the 'A' needles) only knitting. |
| Knitting Feed 2: | All cylinder needles only knitting. |
| Knitting Feed 3: | All dial needles only knitting. |
| Knitting Feed 4: | All cylinder needles knitting; intervening dial needles (the 'B' needles) only knitting. |
| Knitting Feed 5: | All cylinder needles only knitting. |
| Knitting Feed 6: | All dial needles only knitting. |

As will be understood the first weft inserting feed precedes Knitting Feed 1 whereas the second weft inserting feed precedes Knitting Feed 4.

In FIG. 4 are shown the rotary needle dial 1 and the rotary needle cylinder 2 of the knitting machine to which the illustrated example is applied. Numeral 3 denotes the dial needles which are slidable longitudinally in radial tricks in the dial 1 in conventional fashion. A few loops of knitted fabric are shown at 4 on one of the dial needles.

The hereinbefore mentioned weft inserting wheel on which the fabric of this invention may be produced is generally denoted 5, being mounted on a part of the frame of the machine at a location which is stationary with respect to the rotary cylinder and dial.

As can be seen most clearly in FIG. 5, the wheel 5 comprises a hub 6 provided with a peripheral series of spaced relatively fixed and rigid nibs 7 the outer ends of which are formed with V-shaped grooves 8 (FIG. 4) which serve to guide a weft yarn Y which is to be inserted into and interlaced with the rib fabric produced by the co-operable cylinder and dial needles of the machine. The yarn Y passes to the wheel 5 from a bobbin (not shown) through a pot eye P mounted on a bracket B secured to the fixed frame of the machine. It will be noted that the wheel 5 is disposed with its axis of rotation horizontal such that the radially extending nibs 7 at the lower part of the wheel project downwardly between certain of the dial needles 3.

The weft inserting wheel 5 is secured to a shaft 9 mounted for rotation relative to the machine frame. Inwardly of wheel 5 the shaft 9 is formed, as shown in FIG. 4, with a spur gear wheel 10 which is of a pitch related to the gauge of the machine and the teeth 10*a* of which mesh with the stems of dial needles 3. Thus, as the dial 1 rotates when the machine is in operation, the gear wheel 10, and hence the weft inserting wheel 5, is rotatably driven at a speed directly related to that of the machine.

The cams which operate the dial needles 3 are arranged so that these needles adopt a 1 × 1 configuration as they approach and pass beneath the weft inserting wheel, the direction of motion of the dial needles being indicated by arrow M in FIGS. 5 and 6.

Referring to FIG. 6, it will be noted that the dial needle $3^1$ shown at the bottom of this view is in the course of being advanced to tuck position TP, whilst the adjacent dial needle $3^2$ is retracted to miss position MP; the next needle $3^3$ is also being advanced to position TP and the following needle $3^4$ is still retracted. Like numerals are used to identify these particular dial needles in FIG. 5. For convenience in FIG. 6, alternate needles are shown speckled whereas the intervening needles are cross-hatched.

By virtue of this needle configuration, the weft yarn Y which is guided to the dial needles by the weft inserting wheel is laid across the alternate dial needles advanced to TP but misses and is pressed by the nibs 7 below the plane of the intervening dial needles retracted to MP. Then, as these retracted needles progressively advance (as shown at $3^5$, $3^6$, $3^7$, and $3^8$) their backs engage the yarn Y so that it passes alternately to the fronts and backs of the alternate and intervening needles respectively. As can be clearly seen in FIG. 5 at R the yarn is thereby caused to adopt a zig zag configuration.

Following the weft inserting wheel 5 in the direction of rotation of the machine are succeeding knitting stations at which the inserted weft yarn Y becomes thrown off the dial needles without being knitted and is consequently interlaced with the rib fabric produced by virtue of passing alternately behind and in front of knitted loops in successive wales.

At the knitting stations the cylinder needles (not shown) working in the cylinder 2 co-operate with the dial needles 3 in the production of rib knitted fabric. At each weft yarn inserting station, however, the cylinder needles are fully retracted into the cylinder 2 as they pass idly beneath the relevant weft inserting wheel 5 — remaining down until, having safely passed by the said wheel, they are raised to clearing position at a knitting station.

In FIG. 6, the path followed at the weft inserting station by the heads of the alternate (speckled) dial needles, which path is determined by action of a cam in the dial cam cap (not shown) on butts on the stems of these needles, is defined by the thin chainline 11, whereas the path followed by the heads of the intervening (cross-hatched) needles determined by action of another cam on butts on these intervening needles is defined by the relatively thick chain line 12.

Thus, after the alternate dial needles such as $3^1$ and $3^3$ have been advanced to TP, and the nibs 7 have pressed the weft yarn Y beneath the plane of the intervening needles such as $3^2$ and $3^4$, the said intervening needles are also progressively advanced to TP (as indicated at $3^5$, $3^6$, $3^7$ and $3^8$) so that the inserted weft yarn is beneath them. Simultaneously, the alternate needles previously advanced to TP are again retracted to MP with the weft yarn held in their hooks. The intervening dial needles at tuck (non-knit) position thereupon proceed to the first knitting station beyond the wheel 5 where they are cleared, receive yarn and knit, the inserted weft yarn remaining at the backs of these needles so that it is not knitted thereby. The alternate dial needles with the inserted weft yarn held in their hooks, on the other hand, pass on to a succeeding knitting station at which they also are cleared, take yarn and knit, the weft yarn being knocked-over these needles together with knitted loops but without itself being knitted.

The fabric illustrated in FIG. 1 is, as before stated, knitted on an eight-feed circular knitting machine. But, if the knitting machine is, say, a 24-feed double jersey machine equipped with eight weft inserting wheels 5 located at equal spacings round the dial 1, then one weft yarn will be inserted for each three courses of knitted loops.

Although in the illustrated example, each weft inserting wheel 5 is arranged to function in conjunction with dial needles 3 only, it is to be clearly understood that such a weft inserting wheel may alternatively be arranged with its axis of rotation vertical so that it can function in conjunction with cylinder needles. In this alternative arrangement, the radially extending nibs 7 would at the inner part of the wheel project horizontally inwards between certain of the cylinder needles.

A form of the improved weft knitted fabric having weft yarn inserted or laid into desired courses at one face only may be produced either on a rib transfer machine (equipped with transfer needles or/and transfer points for transference of knitted stitches), or on a links-links machine equipped with double-ended needles transferable from either to the other of two opposed needle beds. In such case it is possible by selective transference either of stitches or of needles to omit, from predetermined portions of the fabric, selected needle loops from the face of said fabric opposite to that in which the weft yarns are inserted. In this way, portions of the inserted or laid-in yarn effect face are exposed suchwise as to provide various pattern effects. For example, patterning panels or stripes can be produced simply by transferring selected loops from needles in one bed to needles in the opposed bed, or by transferring certain needles from one bed to the other, as the case may be. But various geometrical figures or/and other shaped patterns may be produced by selective transference of loops or needles on a jacquard patterning principle.

One example of such a fabric is shown in FIG. 2. Thus, the left-hand side of this figure represents a portion of 1 × 1 rib knitting RK knitted on cylinder needles C and on even dial needles De and odd dial needles Do, whereas the right-hand side shows an adjoining panel of plain knitting PK produced only on dial needles De and Do. As will be seen, the inserted or laid-in wefts, indicated at Y and $Y^1$, are interengaged, without being knitted, with both RK and PK. In this connection, the bights *b* of the inserted weft yarns Y are knocked-over together with rib loops $rw^4$, and the bights $b^1$ of the inserted weft yarn $Y^1$ are similarly knocked-over together with rib loops $rw^5$.

The 1 × 1 rib fabric RK is a pique fabric produced on a two-color jacquard knitting sequence.

In FIG. 2, the numerals 1, 2, 3, 4, 5 and 6 indicate courses. Accordingly, the production sequence of a 1 × 1 rib fabric patterned with plain knit panels (as in FIG. 2) is as follows:

| | | |
|---|---|---|
| COURSE | 6 | Knit EVEN dial needles only. |
| " | 5 | Knit ODD dial needles and all cylinder needles. |
| " | 4 | Inlay yarn Y over EVEN and under ODD dial needles. |
| " | 3 | Knit ODD dial needles only. |
| " | 2 | Knit EVEN dial needles and all cylinder needles. |
| " | 1 | Inlay yarn Y1 over ODD and under EVEN dial needles. |

In FIG. 3, this same knitting cycle is expressed in graph form wherein the notation is as follows:

X = face loop.
O = reverse or rib loop.
● = tuck loop.
— = inserted weft yarn float.
C ≠ cylinder needle.
De = even dial needle.
Do = odd dial needle.
KC = complete knitting cycle.
RK = 1 × 1 rib base.
DK = dial knit only.

Rib or purl fabric incorporating weft inserted yarns in accordance with the invention have the following important advantages:

i. The fabric is highly stable and the inserted yarn cannot be pulled out.

ii. Very coarse or fine count yarns can be inserted on fine gauge machines.

iii. Lightweight fabrics can be produced on coarse gauge machines, and a much wider range of fabric weights can be made than is normal from each gauge of machine.

iv. Fabric widths obtained from 30 inch diameter circular knitting machines are not less than, say, 60 inches.

v. Yarns of low tensile strength can be inserted.

vi. Fancy yarns, e.g., knop, slub, metallic, etc., can be used and only a minimum quantity is required to be inserted for an effect.

vii. A wide range of rib and purl (i.e., two bed) fabrics can be inlaid, and these in turn can be further modified, e.g., by taking needles out to increase the range of effects.

viii. By confining the inserted weft effect to one side only of a fabric the latter may, for example, be so produced as to provide a self-backed suiting fabric.

End-uses for light/medium weight fabrics constructed by the last mentioned technique include shirtings and dresswear, whereas heavier single sided fabrics may be used for suitings and furnishings.

I claim:

1. A weft knitted fabric simulating a woven cloth and in which the looped ground structure thereof comprises concatenations of knitted loops some of which are drawn in one direction to form one face and others in the opposite direction to form another face, characterised in that desired courses of the loops drawn in one direction to form said one face have inserted and locked into them coursewise extending unknitted weft yarn separate from and contrasting with knitted yarn composing said ground structure, said inserted yarn introduced in each of such desired courses, without itself being knitted, being knocked-over together with knitted loops in spaced wales of a subsequent course of said face suchwise as to be locked into the needle loops of one face only of the fabric and selected needle loops being omitted from the face of said fabric opposite to that in which the weft yarns are inserted so as to expose portions of one side of the first mentioned face.

2. Weft knitted fabric according to claim 1, wherein the coursewise spaced points at which the relevant bights of inserted weft yarn are caught into the fabric in each of desired courses, by virtue of being knocked over together with knitted loops, at one face of the fabric, are staggered from course to course so that the exposed knocked-over bights are uniformly distributed over the face.

3. Weft knitted fabric according to claim 1, wherein the inserted weft yarns are decorative.

4. A weft knitted fabric according to claim 1 wherein said exposed portions of one side of the first mentioned face are adapted to provide pattern effects.

5. A weft knitted fabric according to claim 1 wherein the disposition of the omitted loops is such as to provide patterning in the form of plain knit panels.

* * * * *